United States Patent [19]

Fulterer

[11] Patent Number: 4,690,571

[45] Date of Patent: Sep. 1, 1987

[54] PULLOUT GUIDE ASSEMBLY FOR MOUNTING SLIDING FURNITURE PARTS

[75] Inventor: Manfred Fulterer, Lustenau, Austria

[73] Assignee: Fulterer Gesellschaft m.b.H.

[21] Appl. No.: 866,327

[22] Filed: May 22, 1986

[30] Foreign Application Priority Data

Jun. 17, 1985 [AT] Austria ..... 1787/85

[51] Int. Cl.[4] ..... F16C 29/12; A47B 88/00

[52] U.S. Cl. ..... 384/22; 312/330 R; 384/19

[58] Field of Search ..... 384/18–27, 384/40; 312/330 R

[56] References Cited

U.S. PATENT DOCUMENTS

| | | | |
|---|---|---|---|
| 4,199,200 | 4/1980 | Livingston | 384/19 |
| 4,500,140 | 2/1985 | Lautenschläger, Jr. et al. | 384/19 |
| 4,552,415 | 11/1985 | Fulterer | 384/19 |
| 4,579,402 | 4/1986 | Wenzlick et al. | 312/330 R |
| 4,589,710 | 5/1986 | Röck et al. | 312/330 R |
| 4,595,245 | 6/1986 | Röck et al. | 312/330 R |

FOREIGN PATENT DOCUMENTS

| | | | |
|---|---|---|---|
| 2321876 | 11/1973 | Fed. Rep. of Germany | 312/330 R |
| 2750086 | 5/1979 | Fed. Rep. of Germany | 312/341 R |
| 3213984 | 10/1983 | Fed. Rep. of Germany | 312/330 R |
| 2037573 | 7/1980 | United Kingdom | 312/348 |

*Primary Examiner*—Stuart S. Levy
*Assistant Examiner*—Thomas R. Hannon
*Attorney, Agent, or Firm*—Toren, McGeady & Associates

[57] ABSTRACT

A slide assembly for mounting sliding furniture parts, such as drawers or shelves, including a first rail section operating as the guide rail which is attached at a furniture side wall and at least one other second rail section operating as a sliding rail attached at the sliding furniture part. The first and second rails are movable relative to each other and the second rail is formed with either an L- or a Z-shaped sectional configuration with the sliding furniture part being mounted on a lower horizontal leg of the second sliding rail and being connected thereto upon a support face of the horizontal leg. An adjustment screw mechanism is provided for enabling adjustment of the positioning of the sliding furniture part relative to the horizontal leg of the second rail section. The horizontal leg is also provided with a flat, upwardly bent bracket having a bore therein for receiving an adjustment screw which is threadedly attached into the furniture part. The bracket defines the support face upon which the furniture part is mounted.

6 Claims, 13 Drawing Figures

PULLOUT GUIDE ASSEMBLY FOR MOUNTING SLIDING FURNITURE PARTS

The present invention relates generally to furniture products and more specifically to a guide assembly for mounting a sliding furniture part, such as a drawer or a shelf.

An assembly of the type to which the present invention relates may include a first rail section which operates as a guide rail and which is attached at a side wall of the furniture member. At least one second rail section is provided to operate as a sliding rail which is attached at the sliding furniture part to be mounted. Revolving members are provided between the two rails and the sliding rail is formed with an L- or a Z-shaped cross-sectional profile including a horizontal leg upon which the sliding furniture part is connected. An adjustment screw mechanism is provided for height adjustment of the furniture part,with the adjustment screw mechanism including an adjustment screw arranged so as to be freely rotatable, but so as to have its axial mobility with respect to the horizontal leg limited so that rotation of the adjustment screw will enable adjustable movement of the furniture part relative to the horizontal leg. The head and/or shank area of the adjustment screw directly contiguous with the head is retained at the horizontal leg in a positively locking manner against axial offset while being freely rotatable.

SUMMARY OF THE INVENTION

The present invention is directed toward an improvement in the type of device discussed above, whereby the forces required for compensation and also relatively flexible, extractable furniture parts are absorbed exclusively by the sliding rails and the parts molded on same which is achievable by the proposal that a flat upwardly bent bracket is provided at the horizontal leg adjacent to the adjustment screw with a bore for receiving an attachment screw which can be threaded into the furniture part which rests on the brackets or on a support face of the bracket.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there are illustrated and described preferred embodiments of the invention.

DETAILED DESCRIPTION OF THE PREFERRED EMBODIMENTS

Figure 1:
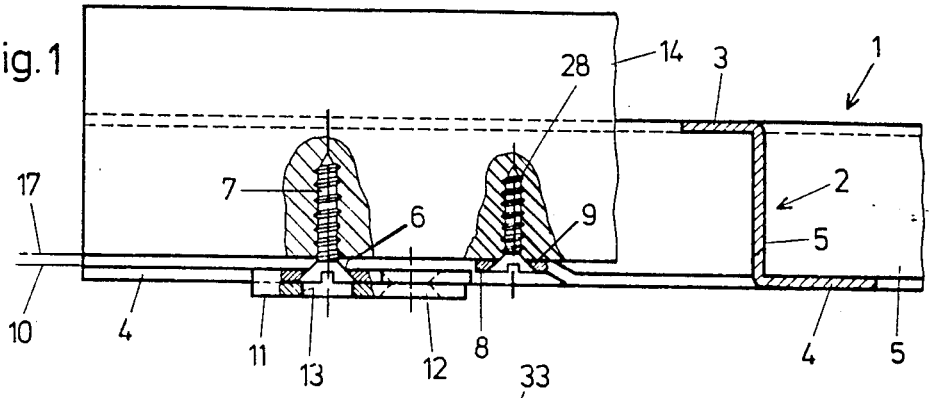
FIG. 1 is a side view of the furniture assembly in accordance with the invention showing the front end of a sliding rail in side view with a superimposed furniture part partially in section viewed in the pullout direction.
Figure 2:
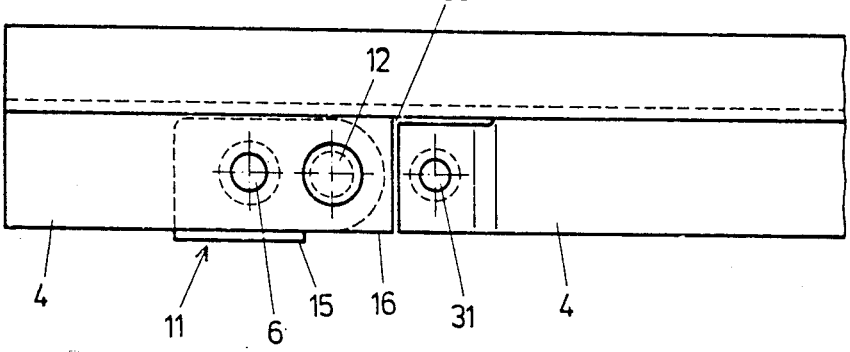
FIG. 2 is a plan view of the assembly with the furniture part removed.

Referring now to the drawings, and more particularly to FIGS. 1 and 2, the present invention is particularly directed toward an assembly for mounting a furniture part 14, which may comprise a drawer or a shelf, so as to be slidably guided. The assembly includes a sliding rail 1 which, as shown in FIGS. 1 and 2, is formed with a Z-shaped cross-sectional configuration comprising an upper horizontal leg 3 and a lower horizontal leg 4, as well as a vertical web 5 connecting the legs 3 and 4.

The sliding rail 1 constitutes the part of the assembly which is attached to the furniture part 14. The rail 1, however, cooperates with another, or first rail section (not shown),which serves as a guide rail and which may be attached at a side wall of a piece of furniture upon which the furniture part 14 is to be mounted. Thus, the sliding rail 1 constitutes at least one second rail section which operates as a sliding rail attached to the sliding furniture part 14.

Revolving members (not shown) are provided between the first rail section (not shown) and the second rail section 1.

Figure 11:
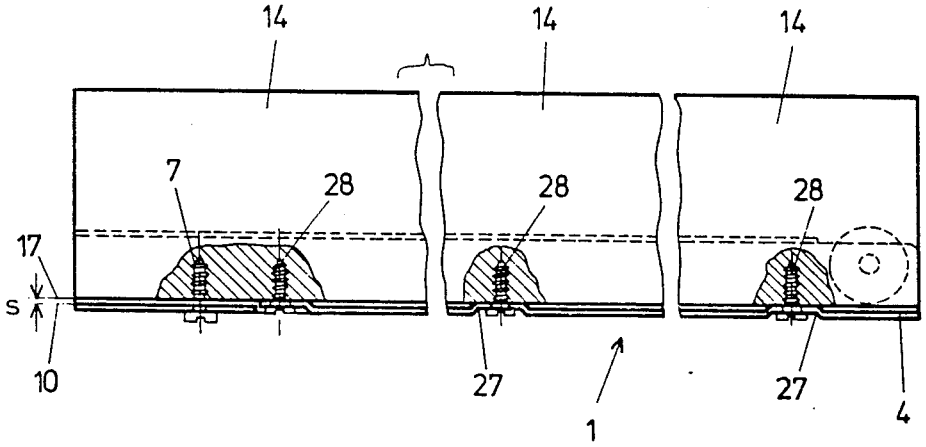
FIG. 11 is a side view partially broken away showing an additional adjustment screw with a groove cut beneath the head in a magnified scale.

Near a front end of the front part of the sliding rail 1, there is provided a countersunk bore 6 for receiving an adjustment screw 7. The adjustment screw 7 is formed with a countersink or tapered head and is provided in the lower horizontal leg 4 of the rail 1. Behind the bore 6, as viewed in the pullout direction of the furniture part 14, there is provided a punched or stamped bracket 8 which defines an upper support face 9 upon which the furniture part 14 is supported. The bracket 8 comprises a bentup part of the horizontal leg 4. As viewed in FIG. 1, it will be seen that the upper surface of the horizontal leg 4 defines a plane 10. The bracket 8 is bent so that its upper support face 9 is arranged to lie in a plane 17 spaced a distance from the plane 10. This distance, as seen in FIG. 11, may be a distance S.

The bracket 8 is strtuctured to extend in the longitudinal direction of the sliding rail with a dimension of between 1 and 2 cm and it is formed with a bore 31 through which an attachment screw 28 may be inserted, the screw 28 being tightly threaded into the furniture part 14, as seen in FIG. 1, so that the furniture part 14 will be pressed against the support face or surface 9 of the bracket 8.

As best seen in FIG. 2, the bracket 8 is formed by forming an L-shaped cutout 33 in the leg 4 and by bending the portion thus formed out of the plane of the leg 4. The cutout or punched out section 33 has one segment which lies directly at the bending edge between the vertical web 5 or the horizontal leg 4 of the sliding rail 1. During fabrication of the bracket 8, the bracket is bent upwardly so that its upper face 9 lies somewhat above the plane 10 of the leg 4.

An additional bracket 11 is pivotably attached by means of a rivet 12 at the lower side of the leg 4. The pivot plane of this bracket 11 lies parallel with the plane 10 of the horizontal leg 4. The bracket 11 is formed with a bore 13 which, when the bracket 11 is pivoted inwardly or in the retracted position shown in FIGS. 1 and 2, lies to extend coaxially with the bore 6 of the horizontal leg 4. The diameter of the bore 13 is made smaller than the outer diameter of the head of the countersink screw 7. The furniture part 14 supported by the sliding rail is shown in FIG. 1. However, in FIG. 2, the furniture part is deleted for the sake of clarity.

The sliding rail 1 may comprise along its length several support zones 27 for support of the furniture part 14 and this is particularly shown most clearly in FIG. 11. The support zones 27 are bent up with respect to the plane 10 of the horizontal leg 4. In order to enable installation of the sliding rail 1 with the extractable or sliding furniture part 14, the bracket 11 must first be pivoted outwardly and laterally so that the bore 6 and the horizontal leg 4 is exposed. The sliding rail 4 is now superimposed at the edge of the furniture part 14 and the attachment screws 28 may be threaded in place. These are provided in large numbers, as a rule, along the length of the sliding rail. The furniture part 14 rests with its front area upon the support face 9 of the bent bracket 8 where it is also retained by the attachment screws 28 provided at that location. The adjustment screw 7 is then threaded into place and,subsequently,the second bracket 11 is pivoted inwardly so that it assumes the position shown in FIGS. 1 and 2 with respect to the horizontal leg 4. In order to limit the pivoting movement of the bracket 11, and for purposes of attitude positioning of the bracket itself, it is formed with a flange or edge 15 which rests at the edge 16 of the horizontal leg 4 when the bracket is pivoted inwardly.

With the assembly arranged as described above, the adjustment screw 7 will then be secured against axial displacement since its countersunk head is retained in a positively locked manner against the bracket 11 in view of the fact that the diameter of the bore 13 is smaller than the outer diameter of the head of the screw 7. After completion of the assembly, if it is found that the drawer or furniture part 14 requires some height adjustment, i.e., adjustment upwardly or downwardly relative to the leg 4 as viewed in the plane of the drawing of FIG. 1, this type of adjustment would be possible with reference to the plane 17 shown in FIG. 1 in a direction upwardly relative thereto as well as downwardly. Such an adjustment is enabled by rotation of the adjustment screw 7. If it is desired to adjust or compensate downwardly, then the screw 7 may be somewhat tightened by means of a screwdriver whose blade may be inserted through the bore 13 of the bracket 11. This will cause the furniture part 14 to migrate downwardly with a simultaneous bending of the bracket 8. In case of upward adjustment, the screw 7 is rotated in the opposite direction, whereby the bracket 8 will be pulled upwardly. Since the screw 7 is retained in a positively locked manner in the axial direction thereof and thus cannot be displaced in this direction, the furniture part 14 will migrate somewhat downwardly and thereby pull the bracket 8 with it. In the embodiment depicted in FIGS. 1 and 2, the bracket 8 is arranged directly behind the adjustment screw 7, as viewed in the pullout direction of the sliding rail 1.

Figure 3:
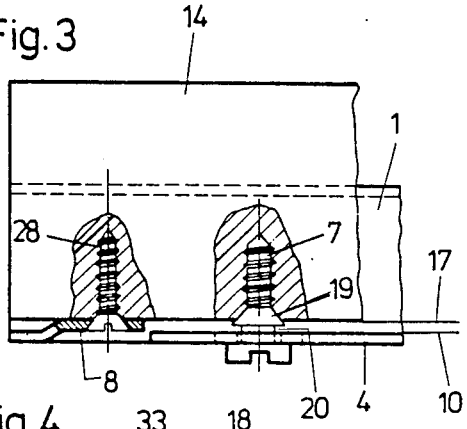
FIG. 3 is a sectional view partially broken away showing a second embodiment of the invention.
Figure 4:
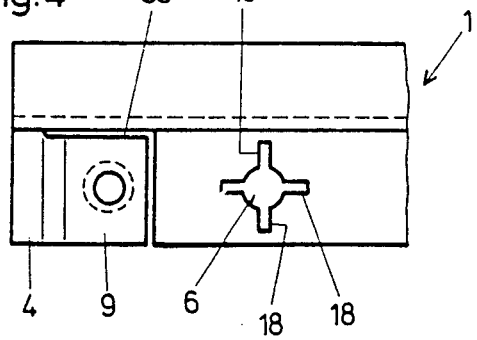
FIG. 4 is a plan view of the embodiment shown in FIG. 3.

A second embodiment of the invention is shown in FIGS. 3 and 4. In this embodiment, and in other embodiments to be discussed hereinafter, identical parts are identified by similar reference characters. In the embodiment of FIGS. 3 and 4, the bore 6 for receiving the adjustment screw 7, which, in this embodiment, is formed with a cylindrical head, is equipped with slits 18 extending outwardly from its edge so that the edge of the bore 6 is formed or bounded by flexible laminar sheets or tongues. As compared with the adjustment screw utilized in the embodiment of FIGS. 1 and 2, the adjustment screw used in FIGS. 3 and 4 has a cylindrical head and a collar 19 with a conical projection on the side facing away from the head at a small distance from the cylindrical head. This collar 19 together with the head borders a circular groove 20. The outer diameter of this collar 19 and the head of the adjustment screw is somewhat larger than the diameter of the bore 6. If this adjustment screw is now threaded into the furniture part 14, then the conical projection of the collar 19 will bend the flexible tongues of the bore 6 somewhat upwardly due to the tensile force exerted by the screw. The tongues will then snap back again into their original position as soon as the collar has moved beyond the edges of the tongues or sheets. Here again, the screw 7 is retained in a positively locking manner at the horizontal leg 4 and is held in position in the axial direction while, at the same time, being freely rotatable. The punched out, upwardly bent bracket 8 for receiving the attachment screw 28 is located before the adjustment screw 7 as viewed in the pullout direction of the sliding rail 1. Here again, the bracket 8 is fabricated or formed by an L-shaped punch or cutout 33. One segment of the L-shaped cutout lies directly in the area of the bending edge between the horizontal leg 4 and the vertical web 5 of the sliding rail 1. In this embodiment, adjustment is also accomplished in the same manner as has already been previously ex- plained.

Figure 5:
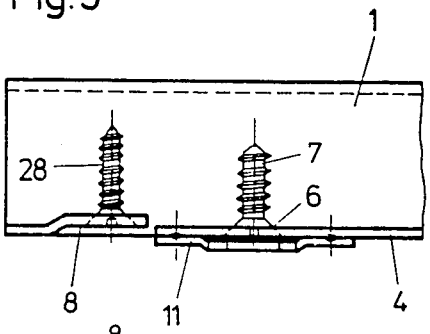
FIG. 5 is a side view showing a third embodiment of the invention.
Figure 6:
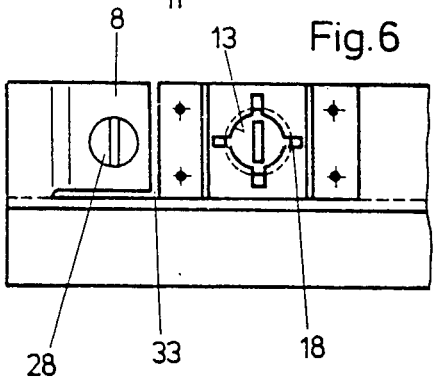
FIG. 6 is a plan view showing the embodiment of FIG. 5 viewed from below.

Another embodiment of the invention is shown in FIGS. 5 and 6. In this embodiment, a bracket 11 is welded or bonded below the countersunk bore 6 for receiving an adjustment screw 7, which, in this case, has a countersink head. The bore 13 of the bracket 11 is equipped with slits 18 extending outwardly from its edge. The countersink head with its conical projection presses the tongues or sheets formed by the slits or incisions 18 inwardly when the adjustment screw 7 is threaded in until the edge of the countersink head of the screw 7 has travelled beyond the tongues, whereupon the tongues spring back into their original position and, as a result, retain the head of the adjustment screw 7 in a positively locked manner.

It will be noted that, in FIGS. 5 and 6 and also in FIGS. 7–10, the furniture part 14 is not depicted for the sake of clarity. The functional mode of the embodiment according to FIGS. 5 and 6 results directly from the previous disclosure and, in this embodiment, the bracket 8 also lies directly adjacent to the adjustment screw 7 and also before the adjustment screw, as viewed in the pullout direction of the sliding rail 1.

Figure 7:
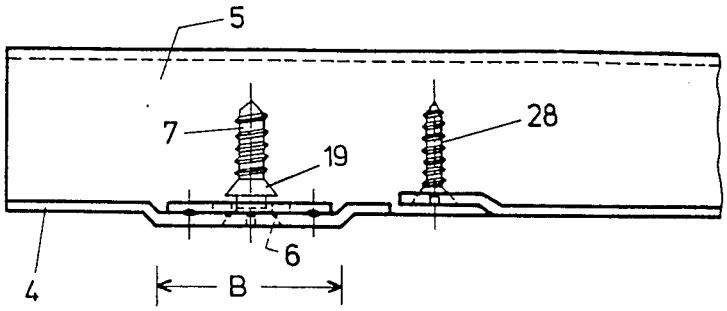
FIG. 7 is a side view showing a fourth embodiment of the invention.
Figure 8:
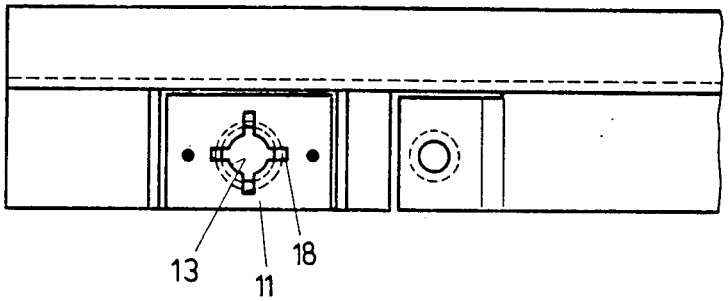
FIG. 8 is a plan view of the embodiment of FIG. 7 as viewed from above with screws removed.

A further embodiment is illustrated in FIGS. 7 and 8. In this embodiment, the adjustment screw 7 equipped with a countersink head has at its shank near the head a collar 19 with a conical projection on the side facing away from the head. The collar 19 together with the head of the screw borders a groove. The area B of the horizontal leg 4 in which the lead through-bore 6 for the adjustment screw 7 is provided, is offset somewhat toward the bottom. On the upper side of this area B offset toward the bottom, a bracket 11 is attached and it may, for example, be welded. A lead through-bore 13 of the bracket 11 is equipped with slits 18 in the same manner as previously explained in connection with the embodiments of FIGS. 3 and 4 and 5 and 6. The bracket 8 with the attachment screw 28 is arranged behind the adjustment screw 7, but also directly adjacent thereto. The functions resulting therefrom derive and are similar to the disclosure previously set forth herein.

Figure 9:
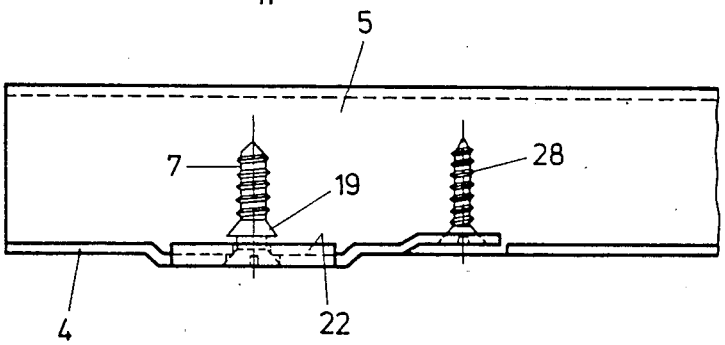
FIG. 9 is a side view of a fifth embodiment of the invention.
Figure 10:
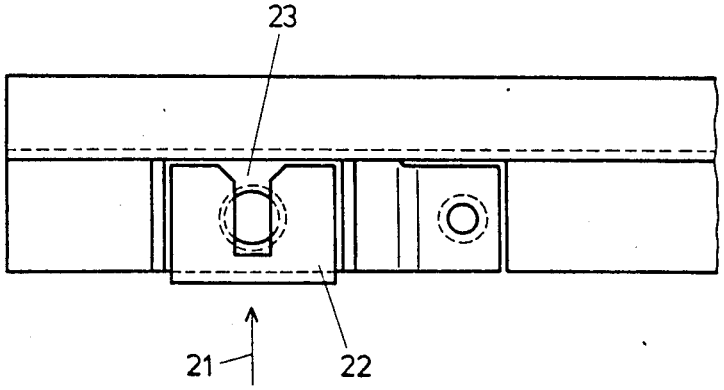
FIG. 10 is a plan view showing the embodiment of FIG. 9 with the screws removed.

In the embodiment depicted in FIGS. 9 and 10, the sliding rail 1 and the adjustment screw 7 are designed in the same manner as in the embodiment shown in FIGS. 7 and 8. A disk 22 inserted from the side indicated by arrow 21 is however provided in this embodiment for axial positioning of the adjustment screw. The disk 22 has a slit 23 with a width which corresponds to the diameter of the shank of the adjustment screw in the groove area. The disk 22 may be bonded in place so that it will be secured against dropping out. In this embodiment, the bracket 8 with the attachment screw 28 is also located behind the adjustment screw 7.

Figure 12:
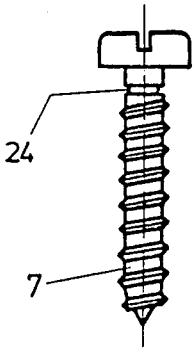
FIG. 12 is a side view of an adjustment screw which may be utilized with the present invention.
Figure 13:
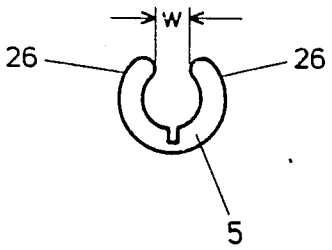
FIG. 13 is a plan view of a lock washer forming part of the assembly of the invention.

Instead of a shoulder or collar 19 which protrudes as against the screw shank, the adjustment screw can be formed with a cut-in groove 24 as shown in FIG. 12 in the vicinity of the screw head. In such case, a thin spring washer 25 depicted in FIG. 13 is provided for positioning in place,with the washer 25 having legs 26 which may be flexibly displaced,whereby the opening width W of the spring washer is somewhat smaller than the diameter of the groove bottom of the groove 24. The spring washer acts in the manner of a circlip lockring and it engages into the groove 24 of the screw 27 if properly assembled. In order to enable installation of the spring washer correctly, it is necessary to exert a small force with which the legs 26 of the washer can be deflected so that the washer can accept between the legs 26 the shank of the adjustment screw 27.

FIG. 11 shows a sliding rail 1 depicted along its entire length in side view and with the furniture part 14 superimposed. As a seat for the furniture part 14, the supports 27 are provided in the rearward area of the rail 1. The supports 27 are formed by short upwardly bent segments of the horizontal leg 4. The supports 27 have, respectively, one lead-through bore for receiving an attachment screw 28. The supports 27 are arranged to define a support plane 17 indicated in FIG. 11. The plane 17 corresponds to the prefabricated position of the support face 9 of the bracket 8,which process has been accomplished in the factory. The adjustment screw 7 in this case is designed as a self-tapping screw and a screw of the type, for example, shown and described in FIG. 2 of Austrian Patent No. 368 609 may be utilized. The screw has a drill projection or a conical thread tip and a sheet metal thread contiguous therewith, whereby a shank segment without threads is located between the self-tapping threads and the screw head, whose axial length corresponds approximately to the thickness of the leg 4 or is slightly larger. A bore of, for example, 2.5 mm in diameter is provided in the factory in the leg 4 for receiving the screw and the screw 7 has, however, an external diameter of approximately 3.5 mm. During assembly, the screw is threaded at a distance such that its thread travels entirely through the bore, and finally, the bore receives the shank segment without a thread. With this, the screw is secured against being removed and such security arrangements are described in various forms in the aforementioned Austrian Patent No. 368 609.

The plane 17 characterizes a reference plane from which, in case of necessity, compensation or adjustment upwardly or downwardly may be effected. In the course of such adjustment, the attachment screws 28 are not actuated, but rather, the adjustment screw 7 is exclusively utilized. The sliding rail or the upwardly bent support 27 and above all the bracket 8 are sufficiently deformable and resilient so that, with tightened adjustment screws 28, the correction which is usually required can be achieved solely by rotation of the adjustment screw 7. Experience has shown that the extent of the adjustment will be approximately plus or minus 2 mm.

FIG. 11 shows a rail 1, at whose rear area upwardly bent supports 27 are provided. It is also conceivable in principle to do without the upwardly bent supports 27 while keeping the upwardly bent bracket 8 and to superimpose the furniture part 14 with its rear portion directly on the horizontal leg 4 of the rail 1 which extends in a flat fashion. In this case, the leg 4 and the lower edge of the furniture part 14 extend along a portion of its front area in a somewhat diverging manner with respect to each other. This is because the furniture part 14 lies flush upon the leg 4 with its rear section with a gap remaining however in the front portion because of its support upon the bracket 8. This gap is at least S in width (see FIG. 7) in order to leave sufficient room for a required correction in case of necessity. This arrangement could approximately correspond to FIG. 3 of Austrian Patent A 4083/84.

Pullout guides of the type herein described are always utilized in pairs for each retractable furniture part. Each pair has at least two rails. The invention here described can also be successfully used in such pullout guides which are designed in a telescoping fashion or as differential extractors in which, therefore, a third rail is provided between the fixed furniture rail and the sliding rail. As revolving members, sliding rollers can be utilized which, as a rule, are supported at the corresponding rails in a stationary manner. Instead of such sliding rollers, sliding carriages are also possible which constitute separate components and which lie between the rails. As has been explained in connection with FIG. 11, the bent-up zones are provided preferably in the rearward area of the horizontal leg 4 and they serve as supports 27 for the furniture part and,by means thereof,-the required free space for the displacement can be achieved. Instead of such bent-up zones, it is also possible to provide small shims between the horizontal leg 4 and the furniture part 14. Additionally, a strip-shaped insert in the rearward area could also be utilized for this purpose. It is essential for such inserts or bent-up supports that they provide a free space S from whose border plane or border line 17 a correction in both directions is possible.

Thus, from the foregoing, it will be seen that the present invention provides a pullout guide assembly which enables performance of a subsequent height correction or height adjustment in the pullout guide for the sliding furniture parts 14. Such adjustment may be required due to insufficiently accurate installation of the guide rail or possibly because the furniture part 14 has become distorted. An adjustment screw 7 is provided in the front area of the horizontal leg 4 of the sliding rail 1 supporting the furniture part 14 and this adjustment mechanism is arranged so that the screw 7 is retained in a positively locking manner at the horizontal leg 4, while being freely rotatable,so that it cannot move in the axial direction with respect to the leg 4. Adjacent to the adjustment screw mechanism, there is provided a bracket 8 which is punched out by means of the L-shaped punched cutout 33. The bracket 8 is bent up somewhat and has a bore 31 for receiving the attachment screws 28. By rotating the adjustment screw 7 which is supported in a stationary manner axially with respect to the sliding rail 1, furniture part 14 can be moved with respect to the reference plane 17 in two directions relative to this plane, whereby, simultaneously, the bent bracket 8 is additionally bent in a direction determined by the adjustment direction of the part 14, depending upon the sense in which the adjustment screw 7 is rotated. Thus, the gap formed by the planes 10 and 17 may be increased or reduced.

While specific embodiments of the invention have been shown and described in detail to illustrate the application of the inventive principles, it will be understood that the invention may be embodied otherwise without departing from such principles.

What is Claimed is:

1. A pullout guide assembly for mounting a sliding furniture part such as a drawer or shelf on furniture comprising: a first rail section serving as a guide rail attached at a side wall of said furniture; at least one second rail section serving as a sliding rail attached to said sliding furniture part, said second rail section having one of an L- or Z-shaped cross-sectional configuration including a lower horizontal leg having said sliding furniture part attached thereto; means provided between said first and second sections to enable sliding movement therebetween; adjustment screw means interposed between said second rail section and said sliding furniture part operable to enable height adjustment of said furniture part with respect to said horizontal leg, said adjustment screw means including an adjustment screw threadedly engaged in said furniture part having a head portion retained in engagement with said horizontal leg to restrain axial mobility of said screw with regard to said horizontal leg while enabling relative rotation therebetween; and a flat upwardly bent bracket provided at said horizontal leg having a bore therethrough for receiving an attachment screw threadedly engaged in said furniture part, said bracket having a support face upon which said furniture part is supported.

2. A guide assembly according to claim 1, wherein said bracket is formed by an L-shaped cutout in said horizontal leg, said L-shaped cutout having a segment extending in the longitudinal direction of said second rail section lying in an area of a bending edge between said horizontal leg and a web of said sliding rail extending perpendicularly to said horizontal leg.

3. A guide assembly according to claim 2, wherein said horizontal leg lies in a first plane and wherein said bracket is bent so as to define said support face to lie in a plane spaced from but parallel to said plane of said horizontal leg, said bracket being resiliently movable by operation of said adjustment screw means to enable said support face to be moved relative to the plane of said horizontal leg during adjustable movement of said sliding furniture part.

4. A guide assembly according to claim 1, wherein said bracket is structured to extend in the longitudinal direction of said sliding rail with a dimension of between 1 and 2 cm.

5. A guide assembly according to claim 1, wherein said horizontal leg has attached thereto a pivotable bracket having an opening which covers a head of said adjustment screw and which permits access to said adjustment screw to enable rotative movement thereof while preventing axial movement thereof relative to said horizontal leg.

6. An assembly according to claim 1, wherein said bracket is located adjacent said adjustment screw means and on a side thereof taken in the longitudinal direction of said second rail section.

* * * * *